US005722340A

United States Patent [19]

Sweetman

[11] Patent Number: 5,722,340

[45] Date of Patent: Mar. 3, 1998

[54] FAIRING FOR MARINE RISERS

[75] Inventor: John A. Sweetman, Farmers Branch, Tex.

[73] Assignee: Mobil Oil Corporation, Fairfax, Va.

[21] Appl. No.: 764,410

[22] Filed: Dec. 11, 1996

[51] Int. Cl.[6] ..... F15D 1/10

[52] U.S. Cl. ..... 114/243; 405/211

[58] Field of Search ..... 114/243; 405/224.2, 405/211; 166/367; 52/84

[56] References Cited

U.S. PATENT DOCUMENTS

| | | | |
|---|---|---|---|
| 1,700,660 | 1/1929 | Williams | 114/90 |
| 3,611,976 | 10/1971 | Hale | 114/243 |
| 3,729,756 | 5/1973 | Cook et al. . | |
| 4,078,605 | 3/1978 | Jones . | |
| 4,171,674 | 10/1979 | Hale . | |
| 4,398,487 | 8/1983 | Ortloff et al. . | |
| 4,474,129 | 10/1984 | Watkins et al. . | |
| 4,477,207 | 10/1984 | Johnson . | |
| 5,279,368 | 1/1994 | Arnott . | |
| 5,410,979 | 5/1995 | Allen et al. . | |
| 5,421,413 | 6/1995 | Allen et al. . | |

*Primary Examiner*—Sherman Basinger
*Attorney, Agent, or Firm*—Malcolm D. Keen

[57] ABSTRACT

A marine riser system having a fairing rotatably mounted thereon. The fairing is comprised of two substantially identical components which when assembled around the riser form a wing-like structure which weathervanes about the riser. Each fairing component is configured so that it will nest within the others thereby saving valuable storage space. Each fairing is mounted on the riser by a pair of bearing collars which are spaced at a distance substantially equal to the width of the fairing. Each bearing collar is made in two parts for easy assembly and each has two spaced bearing surfaces thereon. One end of one fairing is mounted onto one of the collar's bearing surfaces while one end of an adjacent fairing is mounted on the other bearing surface.

8 Claims, 2 Drawing Sheets

FAIRING FOR MARINE RISERS

DESCRIPTION

1. Technical Field

The present invention a fairing for a marine riser and in one of its aspects relates to a fairing for reducing hydrodynamic stresses on a marine riser and a bearing collar for rotatably mounting the fairing on the riser wherein the fairing components are configured so that they are easily stacked to thereby substantially reduce the required storage space aboard the vessel installing the fairings.

2. Background

When drilling and/or producing hydrocarbons or the like from subterranean deposits which lie under a body of water, it is necessary to provide a marine riser system for establishing fluid communication between the surface and the marine bottom. A typical marine riser system normally consists of a one or more fluid-conducting conduits which extend from the surface to a structure (e.g. well head) on the marine bottom. For example, in drilling a submerged well, a drilling riser usually consists of a main conduit through which the drill string is lowered and through which the drilling "mud" is circulated from the lower end of the drill string back to the surface. In addition to the main conduit, it is conventional to provide auxiliary conduits, e.g. choke and kill lines, etc., which extend parallel to and are carried by the main conduit.

As the depth of the water increases, it is common to surround at least a portion of the main and any auxiliary conduits of the riser with a foam material (e.g. syntactic foam) to add buoyancy to the riser. This material is usually applied in the form of hemi-cylinders which, in turn, are strapped, clamped, or otherwise attached in pairs around the riser at the appropriate places. As will be understood by those skilled in the art, this foam material may also provide other functions, e.g cradle and protect the auxiliary lines, provide fixation points for electric cables or the like, etc.. For a good discussion of syntactic foam and how it is used to provide buoyancy for marine risers, see U.S. Pat. No. 4,474,129, issued Oct. 2, 1984.

The resistance to lateral forces due to the bending stresses in the riser decreases as the depth of the body of water increases. Accordingly, the adverse effects of drag forces against the riser caused by strong and shifting currents in these deep waters increase and set up stresses in the riser which can lead to severe fatigue and/or failure of the riser if left unchecked. For a good discussion of how such current-induced stresses affect marine risers, see U.S. Pat. No. 4,398,487, issued Aug. 16, 1983. To alleviate such stresses, it is common practice to attach fairings at spaced intervals along at least a portion of the riser.

As understood by those skilled in the art, fairings are generally comprised of wing-like, streamlined bodies which are rotatably mounted on the riser so that each can "weathervane" about the riser in response to the currents in the water. This allows the leading edge or nose of the body of the fairing to point into the direction from which the current is flowing thereby substantially causing the body of the fairing to become aligned with the current. Several different fairings along with respective means for attaching them to marine risers are known in the art; e.g. see U.S. Pat. Nos. 4,078,605; 4,171,647; 4,398,487; and 4,474,129. While each of these fairings appear to work well for this purpose, it is considered that there is still room for improvement in fairings of this type.

For example, known fairings are typically made in two basically similar halves which are placed and joined together around the riser. Each half of these fairings is a relatively large structure (e.g. 6 feet in width and 8 feet in length). Since a typical riser normally requires several fairings, the handling and storage of the large fairing components aboard the vessel used for installation and/or retrieval can be a real problem. That is, the storage room needed aboard a vessel for a large number of these large fairing components may be more than is reasonably available on that vessel. If this be the case, several vessels may be required which obviously leads to a substantial increase in both the time and costs involved in installing/retrieving the fairings from a marine riser.

Further, in handling, installing, and/or retrieving a marine riser system, the costs involved can be substantially reduced by being able to easily and quickly assemble or disassemble the fairings onto or off of the riser. Accordingly, there exists a need for a simple means for rotatably mounting the fairings on the riser without substantially damaging the foam material which will normally be present on the riser at those points at which the fairings are normally mounted. The less time spent in installing and adjusting the mountings for the fairings can result in substantial savings.

SUMMARY OF THE INVENTION

The present invention provides a marine riser system having at least one fairing rotatably mounted thereon for alleviating the hydrodynamic stresses imposed on the riser by strong and/or shifting currents. The fairing is basically comprised of two substantially identical halves or components which when assembled around the riser form a wing-like structure which comes to a point at the back or trailing edge and is curved at its front. Each of the components has an elongated, wing-like surface which is open at one end and which has a wall plate extending inwardly from the other end.

The wall plate is configured to extend from its end of its component to the open end of the other fairing component when two fairing components are "reversed" and assembled on the riser. That is, the wall plate on one component effectively closes one end of the assembled fairing while the wall plate on the other component effectively closes the other end of the assembled fairing. Each of the wall plates have a partial-circular recess therein which is adapted to receive a bearing collar on the marine riser when the fairing is assembled thereon.

Since the wall plates are the only structure extending inwardly of the wing-like surface of the fairing components, each component can be oriented so that all of the fairing component will nest within the others. This allows several of the large components to be compactly stacked aboard a vessel thereby saving valuable storage space and allowing a greater number of components to transferred and handled by a single vessel.

Each fairing is rotatably mounted onto the marine riser by a pair of bearing collars which form part of the present invention. The bearing collars are spaced from each other at a distance which is substantially equal to or slightly greater than the width of the fairing to be mounted. Each of the bearing collars is comprised of a first and second collar component which are configured to encircle the riser when they are connected together in an operable position around the riser.

Each of the collar components has two spaced bearing surfaces thereon which are separated by a mid-section; said respective bearing surfaces adapted to align with each other to form an upper and a lower circular bearing surface around said the riser when said components are in an operable position. The lower circular bearing surface on one of said bearing collar is adapted to be received within the recess within the "upper" wall of the fairing while the upper circular bearing surface on the other of the bearing collars is adapted to be received within the recess within the "lower" wall of the other fairing component. Further, a slot is provided within said mid-section of said first bearing collar component which is adapted to receive a clamping element which can be moved into the slot and into contact with the riser to thereby secure the bearing collar to said riser.

Typically, the fairings of the present invention are assembled onto a marine riser system having a main conduit which is adapted to extend from the surface of a body of water to the marine bottom. As will be understood, at least a portion of the main conduit is usually surrounded by a foam material to provide buoyancy to the main conduit. The first and second bearing collar components are positioned around the foam material and are connected together by bolts or the like. The clamping element is the moved into the slot in the first collar component (e.g. by threaded bolts or the like) where it engages the foam to secure the collar in place without causing any substantial damage to the foam. A second collar is spaced from the first collar at a distance substantially equal to width of the fairing and is secured to the foam around the riser as described above.

Two of the fairing components are then positioned around the riser and between the bearing collars. The fairing components are "reversed" as they face each other so that the wall of one component is at the top of the fairing while the wall of the other component is at the bottom of the fairing. The recess in the top wall receives the bottom bearing surface of the top collar while the recess in the bottom wall receives the upper bearing surface of the lower collar. The two fairing components each have releasable means mounted on their respective forward and rear ends which respectively cooperate with with each other to secure the fairing components together in an operable position around the riser. Once the fairing is assembled, it is free to rotate about the riser on the bearing surfaces of the collars.

BRIEF DESCRIPTION OF THE DRAWINGS

The actual construction, operation, and the apparent advantages of the present invention will be better understood by referring to the drawings which are not necessarily to scale and in which like numerals identify like parts and in which.

BEST KNOWN MODE FOR CARRYING OUT THE INVENTION

Figure 1:
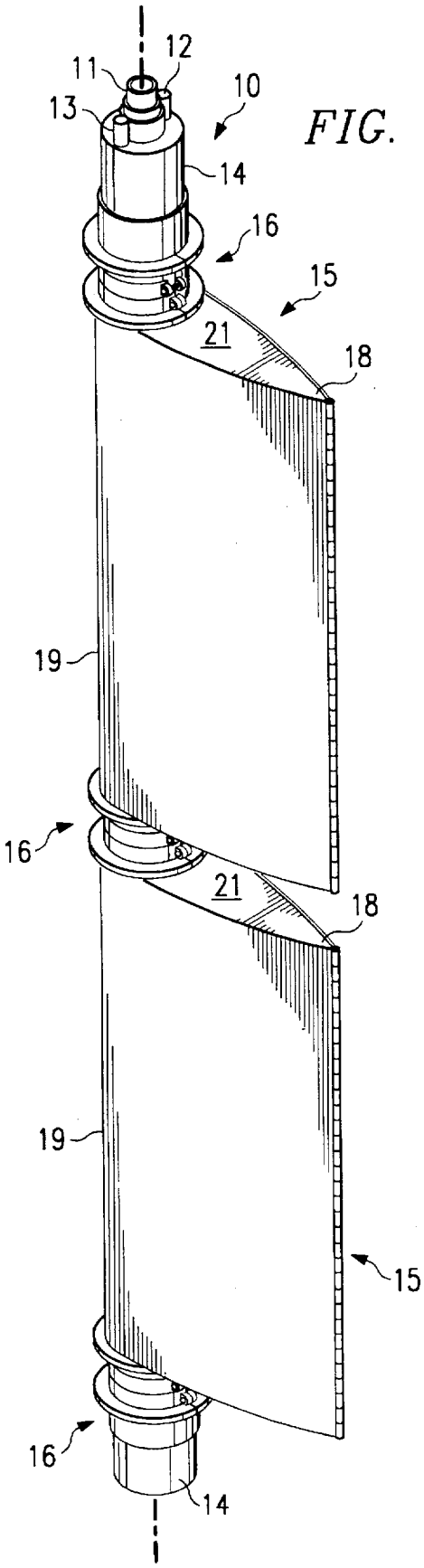
FIG. 1 is an perspective view, partly in section, of a buoyant section of a marine riser on which two fairings of the present invention have been installed in accordance with the present invention.

Referring now to the drawings, FIG. 1 discloses a marine riser 10 having a main conduit 11 with auxiliary lines 12 and 13 running parallel thereto. While riser 10 is illustrated as a drilling conduit 11 with choke 12 and kill line 13 parallel thereto, it should be understood that the present invention could be used equally as well with other marine risers, e.g. production risers, without departing from the present invention.

As will be understood by those skilled in the art, main conduit 11 may be surrounded for at least a portion of its length by one or more buoyancy modules 14 which have passages therein to receive and protect lines 12 and 13. The modules 14 are comprised of a buoyant material, e.g. syntactic foam, and are positioned along the riser to stiffen or provide flexibility to the riser as the case may be. Again, for a good discussion of syntactic foams and how they are used to provide buoyancy for marine risers, see U.S. Pat. No. 4,474,129.

Figures 2, 4:
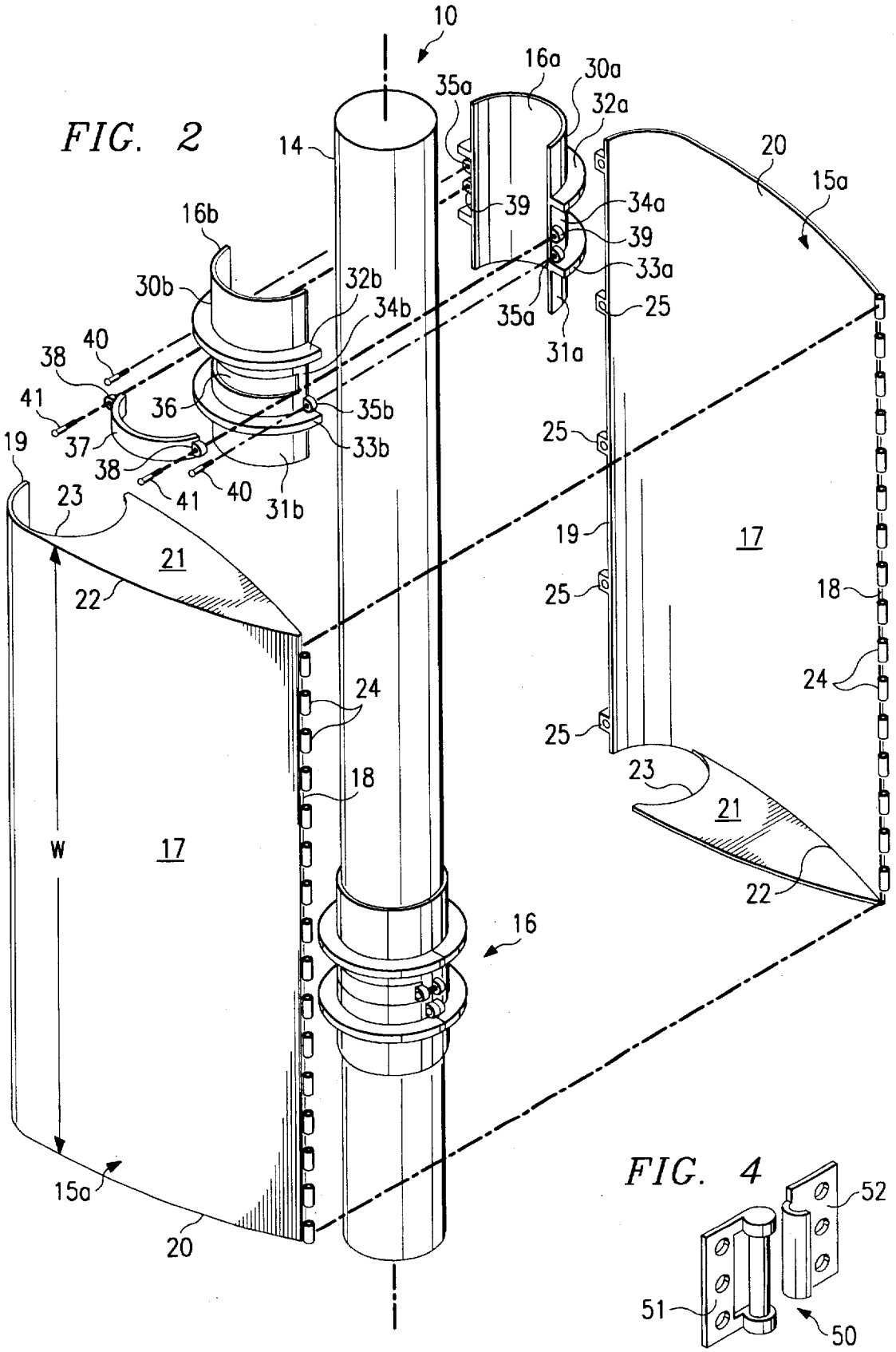
FIG. 2 is a partially-exploded view of one of the fairings and one of the bearing collars of FIG. 1.
FIG. 4 is a perspective view of another embodiment of a releaseable means for connecting two fairing components together to form the fairing of FIG. 1.

Fairings 15 are spaced along riser 10 and are rotatably mounted thereon by means of bearing collars 16. Each fairing 15 is comprised of two components **15*a* which, in turn, are identical in construction. That is, each component 15*a* is comprised of an elongated, wing-like curved surface 17 which comes to a point at its rear or trailing edge 18 and is relatively semi-circular in cross-section at its front or leading edge 19, as best seen in FIG. 2. One end 20 is open while a wall plate 21 extends inwardly at the other end 22. Wall plate 21 is configured so that it will effectively extend between the respective components 15*a* when the components are reversed and positioned on the riser. That is, the wall at one end on one component will effectively close one end of an assembled fairing while the wall on the one end of the other component will effectively Close the other end of the assembled fairing as shown in FIG. 2**.

Each wall 21 has a substantially partial-circular recess or opening 23 therein which is sized to receive and rotatably fit around bearing collar 16 as will be more fully discussed below. A plurality of hinge-like members 24 or the like are spaced along trailing edge 18 and have passages therethrough which align when two components **15*a* are in position around riser while spaced eyelets 25 are provided along the front 19 which have openings therein which align when fairing 15** is assembled.

While the fairing components 15 can be made from any fairly rigid material, e.g. aluminum, fiberglass, etc., preferably they are made from lightweight, buoyant material such as syntactic foams (i.e. thermosetting plastic such as epoxy or polyester resin having glass microspheres embedded therein).

Bearing collars 16 are also comprised of two components or halves **16*a* and 16*b* which have basically the same configuration but differ slightly. That is, both component 16*a* and 16*b* have two bearing surfaces 30*a*, 31*a* and 30*b*, 31*b*, respectively, which are separated by flanges 32*a*, 33*a*, 32*b*, 33*b*, which respectively define mid-sections 34*a*, 34*b* on the respective bearing collar components. Eyelets 35*a*, 35*b* are provided within mid-sections 34*a*, 34*b*, respectively, which align when components 16*a*, 16*b* are in an assembled position. Mid-section 34*b* has a slot 36 therein which is adapted to receive clamping element 37 which, in turn, has eyelets 38 thereon which align with eyelets 39 within mid-section 34*a* of collar component 16*a***. Again, the collar components can be constructed of metal or preferably are made of a strong plastic material as will be understood in the art.

Figure 3:
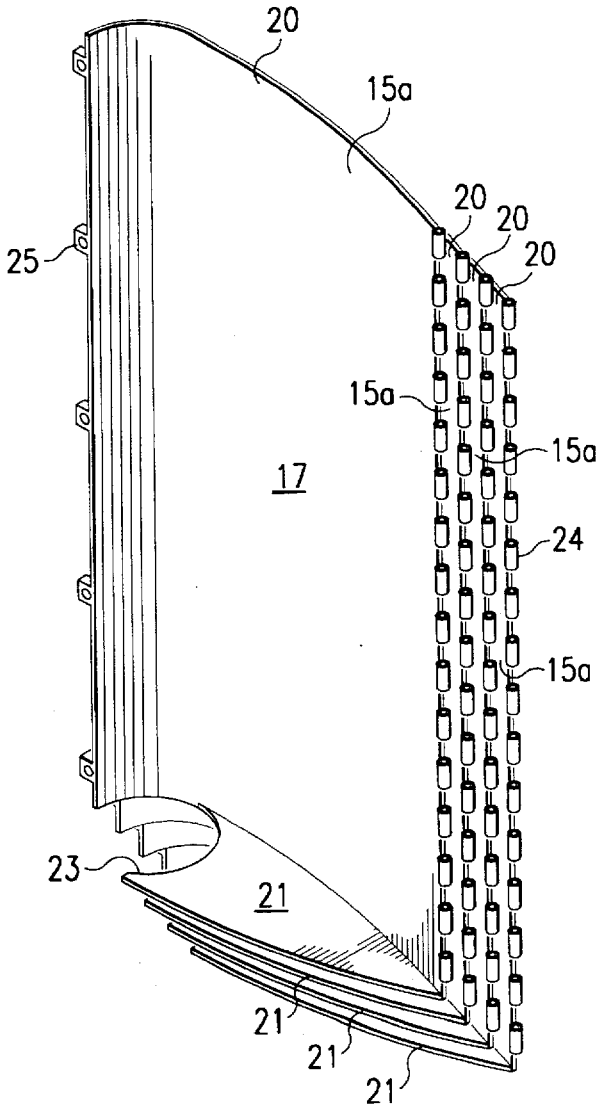
FIG. 3 is a perspective view of several fairing components of FIG. 1 in a stacked or nested position.

Since all of the fairing components **15*a* are identical, they are basically interchangeable thereby making assembly of a fairing 15 easier and quicker than if particular components have to be matched before assembly. Further, since all of the fairing components 15*a* are configured identically without any interfering internal structure, they can easily be stacked or nested within each other (see FIG. 3) thereby greatly reducing the storage area required for a large number of fairings aboard a vessel. This is a very important feature since the fairing components 15***a* are large and each requires a relatively large space for storage.

To assemble the present fairings 15 onto the riser 10, bearing collar components 16*a*, 16*b* are positioned over foam 14 at a selected location and are secured together by means of bolts 40 (FIG. 2) or the like which extend through aligned eyelets 35*a*, 35*b* on the respective collar components. Next clamping element 37 is positioned within slot 36 and bolts 41 or the like are tightened through eyelets 38 on clamping element 37 and aligned eyelets 39 on collar component 16*a* to secure the two together. It can be seen that the tightening of bolts 41 will draw clamping element 37 into slot 36 and into contact with foam 14 around riser 10. Clamping element 37 will engage and compress the foam whereby the friction between element 37 and foam 14 will secure bearing collar 16 in a fixed position on the riser without causing any substantial, lasting damage to the foam.

With a first or lower bearing collar 16 in place, two identical fairing components 15*a* are reversed so that wall 21 of one component is at the top of the fairing while wall 21 of the other component is at the bottom. The lower bearing collar 16 will partially support the weight of the fairing 12 and acts as a spacer for an upper or second bearing collar 16. A second or lower bearing collar 16 is then secured to the riser 10 in the same manner as just described above. The second collar is positioned above the fairing 17 and is lowered into the recess 23 formed in the top of the fairing so that surfaces 31*a*, 31*b* provide a bearing for the upper end of fairing 17. The flanges 33*a*, 33*b* on the second or upper collar are spaced from flanges 32*a*, 32*b* of the first or lower collar at a distance which is substantially equal to or slightly greater than the width W of a fairing 15 (see FIG. 2) and prevents longitudinal movement of the fairing 17 on the riser.

The recesses 23 in the respective walls 21 are positioned around the bearing surfaces 31*a*, 31*b* of the upper bearing collar 16 and the bearing surfaces 30*a*, 30*b* of the lower bearing collar 16 and the two fairing components 15*a* are connected together by (a) passing a pin or the like (not shown) through the aligned passages in hinge members 24 at the front end of the fairing and (b) securing bolts or the like (not shown) through aligned eyelets 25 on the rear of the fairing. It should be recognized that other means can be used to couple the two components 15*a* together without departing from the present invention. For example, a plurality of spaced quick connectors 50 (only one shown in FIG. 4) comprised of cooperating pin element 51 and catch element 52 can be used in place of hinge members 24 to latch the fairing components together as will be understood in the art.

It can be seen that a fairing 15, once assembled between two bearing collars 16, it is free to rotate about the riser 10 on the bearing surfaces of the collars with the flanges on the respective collars limiting longitudinal movement of the fairing on the riser. Further, since each of the bearing collar 16 has an "upper" and a "lower" bearing surface, only one collar is required to secure the lower end of one fairing and the upper end of an adjacent fairing to the riser thereby speeding up installation of the fairings which can substantially reduce the time and costs involved.

What is claimed is:

1. A fairing adapted to be mounted onto a marine riser, said fairing comprising:

two identical fairing components, each component comprising:

an elongated, wing-like surface tapering to a point at its rear and having a curved surface at its front, said wing-like surface being open at one end;

a wall plate extending inward at the other end and configured to effectively extend between said components when said two components are assembled;

said wall plate having a recess therein adapted to receive said marine riser; and means for securing said components together when said components are in an operable position around said marine riser.

2. The fairing of claim 1 wherein each of said fairing components is configured so that each fairing component will nest within another of said fairing components.

3. The fairing of claim 2 wherein said means for securing said components together comprises:

a first releasable means mounted on said rear of each fairing component which respectively align with each other when said fairing components are in an operable position around said riser;

a second releasable means mounted on said front of each fairing component which respectively align with each other when said fairing components are in an operable position around said riser; and means for securing said respective releasable means together when said respective relesable means are aligned.

4. The fairing of claim 3 wherein said first releasable means comprises:

hinge elements mounted on the rear of each component which align with each other; and means for securing said hinge elements together when said respective hinge elements are aligned.

5. A marine riser system comprising:

a main conduit adapted go extend from the surface of a body of water to the marine bottom, at least a portion of said main conduit being surrounded by a foam material to provide buoyancy to said conduit;

at least one fairing having a width adapted for mounting onto a marine riser, said fairing comprising:

two identical fairing components, each component comprising:

an elongated, wing-like surface tapering to a point at its rear and having a curved surface at its front, said wing-like surface being open at one end;

a wall plate extending inward at the other end and configured to effectively extend between said components when said fairing components are assembled; said wall plate having a recess therein adapted to receive said marine riser; and means for securing said components together when said components are in an operable position around said marine riser; and means for rotatably mounting said at least one fairing onto said foam material which surrounds said main conduit.

6. The marine riser system of claim 5 wherein said means for rotatably mounting said at least one fairing comprises:

a pair of bearing collars positioned around said foam material on said main conduit, said bearing collars being spaced from each other at a distance which is substantially equal to or slightly greater that the width of said fairing; each of said bearing collars comprising:

a first collar component and a second collar component; said collar components configured to encircle said foam material when said collar components are in an operable position on said main conduit;

means for securing said first and second collar components together in said operable position on said main conduit;

each of said collar components having two spaced bearing surfaces separated by a mid-section; said respective bearing surfaces adapted to align with each other to form an upper and a lower circular bearing surface around said foam material when said collar components are in an operable position; said lower circular bearing surface on one of said bearing collars being adapted to be received within said recess within said wall plate of one of said fairing components and said upper circular bearing surface on the other of said bearing collars being adapted to be received within said recess within said wall plate of said other fairing component.

7. The marine riser system of claim 6 wherein each of said bearing collars further include:

a slot within said mid-section of said first bearing collar component;

a clamping element adapted to be received within said slot; and means for moving said clamping element into said slot and into contact with said foam surrounding said main conduit to thereby secure said bearing collar to said foam material.

8. A bearing collar for rotatably mounting a fairing to a marine riser, said bearing collar comprising:

a first bearing collar component and a second collar bearing component; said collar components configured to encircle said riser when said components are in an operable position on said riser;

means for securing said first and second bearing collar components together in said operable position on said riser;

each of said bearing collar components having two spaced bearing surfaces separated by a mid-section; said respective bearing surfaces adapted to align with each other to form two circular bearing surfaces around said riser when said components are in an operable position; one of said circular bearing surfaces providing a bearing surface for one end of the fairing to be mounted to the marine riser;

a slot within said mid-section of said first bearing collar component;

a clamping element adapted to be received within said slot; and means for moving said clamping element into said slot and into contact with said riser to thereby secure said bearing collar to said riser.

* * * * *